United States Patent [19]

Kuebler

[11] 4,262,503

[45] Apr. 21, 1981

[54] DOOR SECURITY DEVICE

[76] Inventor: James F. Kuebler, South Trail, Lake Mohawk, Tiffin, Ohio 44883

[21] Appl. No.: 971,555

[22] Filed: Dec. 20, 1978

[51] Int. Cl.[3] ..... E05B 65/06

[52] U.S. Cl. ..... 70/101; 70/DIG. 64; 292/259 R; 292/289; 292/295

[58] Field of Search ..... 70/94, 101, 14, DIG. 64; 292/288-298, 259 R, 338, 339, 343, DIG. 15

[56] References Cited

U.S. PATENT DOCUMENTS

| | | | |
|---|---|---|---|
| 2,130,216 | 9/1938 | Zaninovich | 292/259 |
| 2,703,728 | 3/1955 | Raber | 292/288 |
| 3,570,283 | 3/1971 | Males | 292/288 X |
| 3,997,206 | 12/1976 | Hagopian | 292/290 |

*Primary Examiner*—William E. Lyddane

*Attorney, Agent, or Firm*—Harold L. Stults; Pasquale A. Razzano

[57] ABSTRACT

A security device for preventing the unauthorized opening of swinging doors. The device has two members, each of which includes two parallel tubes and a rectangular metal plate or web. Each pair of tubes is welded to the respective opposite side edges of its metal plate, and the device is adapted to slide along the floor beneath a door when the door is opened with the tubes of each pair upon opposite sides of the door. The tubes of one member are smaller than those of the other, and the pair of smaller tubes extend beyond their plate toward the other member, and are inserted into the respective larger tubes to a nested position. The overall length of the device is then such that the door can be closed. The members are then moved relative to each other from the nested position, i.e., longitudinally of the pipes so as to span the width of the door. Each pair of pipes has extensions beyond the plate which are then positioned upon opposite sides of the door frames. The two members are then secured in that relative position so that the door cannot be opened.

12 Claims, 5 Drawing Figures

Fig. 1
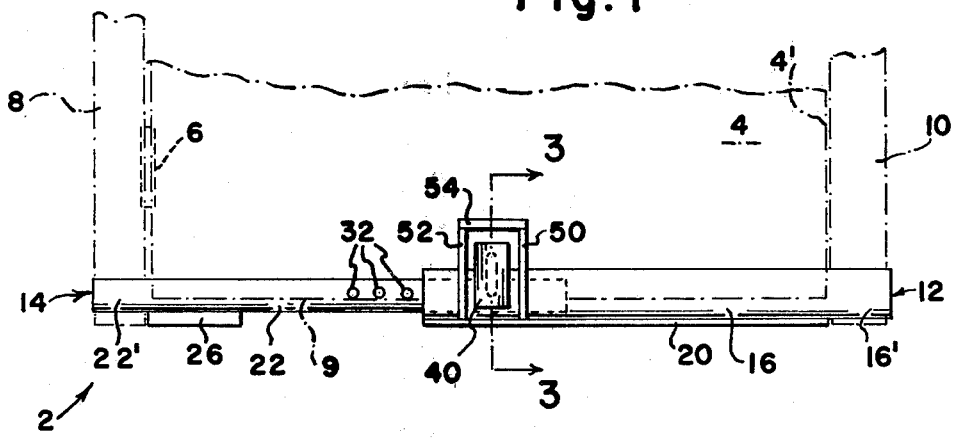
Fig. 2
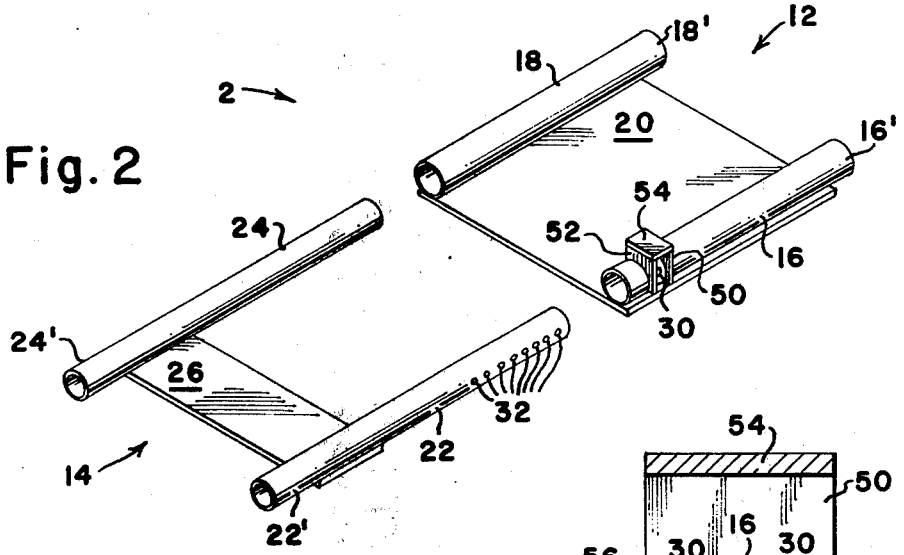
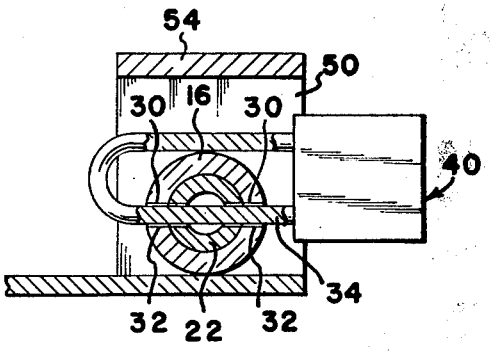
Fig. 3
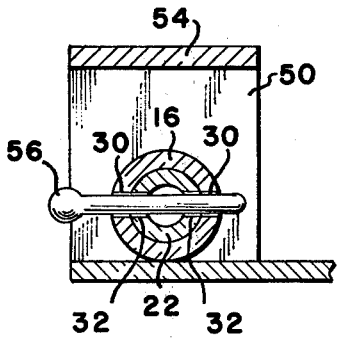
Fig. 4
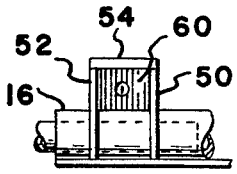
Fig. 5

DOOR SECURITY DEVICE

This invention relates to locking means for swinging doors, and more particularly to a portable construction for use by the occupants of an apartment hotel or motel room or a room in a residence.

An object of this invention is to provide a construction which can be installed at the base of a swinging door and which is effective to prevent the door from being opened, and which can be locked to prevent access to a room by unauthorized people. A further object is to provide for the above with a construction which is readily installed and removed as desired, and which is adaptable to use with doors of different widths and thicknesses. A still further object is to provide for the above with a construction which is portable can be installed without tools, and which does not involve attachments to the door or to the adjacent walls or frames. These and other objects will be in part obvious and in part pointed out below.

In the drawings which show an illustrative embodiment of the invention:

FIG. 1 is an elevation of the security device installed on a door, with the door and its frame shown in broken lines;

FIG. 2 is an exploded view showing the device positioned to be installed on a door;

FIG. 3 is a sectional view on line 3—3 of FIG. 1;

FIG. 4 is a view similar to FIG. 3, but showing another embodiment of the invention; and, FIG. 5 is a view similar to the lower central portion of FIG. 1, but showing another embodiment of the invention.

Referring to FIG. 1 of the drawings, a security device 2 is installed at the bottom of a door 4, which is mounted on hinges 6 (only one of which is shown in broken lines) on one side frame member 8 of the door frame. The door swings from and to the closed position shown where its free edge mates with a side frame member 10.

Security device 2 (see also FIG. 2) is formed by two members 12 and 14, each of which has a pair of parallel tubes 16, 18 and 22, 24, respectively, and a flat web or plate 20, 26, respectively. The outer diameter of each of tubes 22 and 24 is slightly less than the inside diameter of each of tubes 16 and 18, so that tubes 22 and 24 will be snugly received within tubes 16 and 18, respectively. Plate 20 is illustratively three inches shorter than its tubes, with one end of the plate being in alignment with the ends of the tubes and the other end being three inches from the other ends of the tubes. That provides tube ends 16′ and 18′ which project beyond plate 20. Plate 26 is very narrow, with there being three inch tube ends 22′ and 24′ extending beyond one end of the plate, but with the main lengths of the tubes being free of the plate. Hence, with members 12 and 14 positioned as shown in FIG. 2, member 14 can be moved longitudinally so that a major portion of its tubes 22, 24 nest into tubes 16, 18, respectively. Plates 20 and 26 are so positioned upon their pairs of tubes that when the tubes are moved into their fully nested positions, the plates are in abutting alignment. When so nested, members 12 and 14 form a relatively rigid construction, the length of which can be changed by sliding one of the members longitudinally with respect to the other.

Device 2 is installed on a door, as shown in FIG. 1, by first opening the door slightly and then positioning member 14 on the floor adjacent the bottom edge 9 of the door with tubes 22, 24 parallel to the bottom edge of the door and tube 22 outside the room, and with the tube ends 22′ and 24′ upon opposite sides of the bottom edge of the door. The member 14 is then slid longitudinally so that plate 26 moves along the floor under the door, and tubes 22, 24 are on opposite sides of the door. Member 12 is then positioned in alignment with member 14 as shown in FIG. 2, and member 12 is then moved longitudinally toward member 14 with its plate 20 moving along the floor beneath the door and the respective tubes telescope, again to the fully-collapsed position. The door is then closed, and members 12, 14 are moved from their fully-collapsed position so that tube ends 22′ and 24′ are moved upon the opposite sides of frame member 8 and the adjacent wall, and tube ends 16′ and 18′ are positioned upon the opposite sides of frame member 10 and the adjacent wall.

It can be seen that tubes 16 and 22 are then positioned along the outside surface of door 4, i.e., outside the room, and tubes 18 and 24 are positioned along the floor adjacent the bottom edge of the door and inside the room. Tube ends 16′ and 18′ extend along the opposite sides of frame member 10, and tube ends 22′ and 24′ extend along the opposite sides of frame member 8. It should be noted that frame members 8 and 10 may be of such cross-section as to cause portions of the adjacent walls to also be positioned between the tube ends. When members 12 and 14 are positioned in that manner, the door cannot be swung from its closed position because the door edge 4′ is held by tube ends 16′ and 18′ with the assistance of the engagement of the tube ends 22′ and 24′ with frame member 8 and the adjacent wall portions. In effect, tubes 16 and 22 for a continuous rigid tube on the outside of the door, and members 12 and 14 form a rigid construction which prevents the door from moving any appreciable distance away from the door frame.

In accordance with the present invention, provision is made for locking or latching members 12 and 14 in the position of FIG. 1 wherein it acts as a rigid door-securing means. Referring now to FIGS. 1 and 3, pipes 16 and 22 are positioned far enough from the door so that a padlock can be installed to securely hold members 12 and 14 in that position. Tube 22 has a row of diametrically aligned pairs of horizontal bores 32 (see also FIG. 2) extending through its walls, and tube 16 has a single diametrically aligned pair of horizontal bores extending through its walls. As members 12 and 14 are moved relative to each other to the tube-telescoping position, bores 32 move successively into alignment with each pair of bores 30, as shown in FIG. 3. When in any of those aligned-hole positions, the hasp 34 of padlock 40 may then be inserted through the aligned holes 30 and 32 and the padlock is then locked. When the padlock is so positioned, members 12 and 14 cannot be moved relative to each, i.e., from the partially telescoped position of the tubes and the device holds the door from opening. To install the security device on the door, members 12 and 14 are moved to a "locking position" wherein the tube ends are positioned upon the opposite sides of the door frame members as discussed above, and member 12 is moved to a position where a pair of holes 32 is in alignment with holes 30. Hasp 34 of padlock 40 is then inserted into holes 30 and 32. As shown in FIG. 3, when tubes 16 and 22 are positioned within the room, in which case (see FIG. 4) a pin 56 is inserted into the aligned bores 30 and 32. That prevents the door from being opened, but the pin may be easily removed so that the occupant can open the door without delay when it is desirable to do so.

Device 2 is adapted to be installed upon any swinging door of the width of the order of two and one-half feet to three feet, and the pairs of pipes 16, 18 and 22, 24 are spaced so that their respective ends will span walls which are eight inches thick. It has been pointed out above that the series of holes 32 adapts device 2 to be installed upon doors of different widths. Illustratively, the pairs of holes 32 are positioned one and one-half inches apart. Hence, the longitudinal dimension of device 2 can be adjusted in one and one-half inch distances within a predetermined range.

In the illustrative embodiment, members 12 and 14 are constructed of steel or another sturdy metal. As an additional feature (see FIG. 1) a pair of metal fins 50 and 52 is welded to tube 16 upon the opposite sides of bores 30 and 32 and a cover plate 54 is welded to the tops of the fins. That forms a partially closed cavity for padlock 40 and will discourage and impede efforts to damage the padlock and remove the security device from the door.

The embodiment of FIG. 5 is identical with that of FIGS. 1 to 3, except that padlock 40 is replaced by a dead bolt lock 60 mounted on pipe 16 between fins 50 and 52. The dead bolt of the lock is projected through mating holes in any convenient manner in the pipes in the same manner as hasp 34 of lock 40.

In FIG. 1, the inside surface of the door is flush with the adjacent frame and walls so that the rigid structure formed by pipes 16 and 22 is substantially against the door surface and the door cannot be moved from its fully closed position even if all other locking and latching means are rendered inoperative. When the occupant of the room installs the device from outside the room, pipes 18 and 24 are similarly positioned. The feature of providing the extensible elongated members with one telescoping into the other, provides a sturdy construction which is relatively light in weight.

It should be noted that the security device is extensible, and in its installed position has a rigid structure extending along the side of the door in the zone in which the door swings when it is being opened and there is rigid means extending under the door and anchored to the side members of the door frame of the adjacent wall structures. It can be appreciated that the illustrative embodiments are adapted to be used with doors of different widths, but that benefits of the invention are obtained with a structure locked for a specific door width.

It is understood that other modifications can be made in the illustrative embodiment and that other forms of the invention can be provided, all within the scope of the claims.

What is claimed is:

1. A security device for a swinging door comprising the combination of, a pair of cooperating security members each of which comprises a pair of generally parallel laterally spaced elongated members adapted to be positioned on opposite sides of a door and interconnecting means rigidly secured to its associated pair of elongated members, said interconnecting means being adapted to slide beneath a door when the door is partially or fully opened and interconnecting their respective associated elongated members on opposite sides of the doors when the door is closed, said elongated members in each pair having first end portions dimensioned to be telescopically engaged with each other whereby the overall length of the security device may be adjusted, each of said elongated members having second end portions opposite said first end portions which extends beyond their associated interconnecting means and is adapted to extend beyond the vertical edge of the door along an adjacent frame or wall structure, whereby said members form a rigid telescopic structure along the sides of the door in the zone into which the door swings when the door is being opened, and means for releasably retaining said members any of a plurality of selected adjusted telescopic relative positions with said second end portions adjacent the frame of the door, whereby said pair of members limit relative movement between a door and its frame to secure the door from being opened.

2. A security device as described in claim 1, wherein said elongated members comprise rigid tubes wherein the tubes of one pair are dimensioned to be snugly received within the tubes of the other pair, at least one tube in each pair having bores formed in the walls thereof adapted to be positioned in alignment, and said retaining means comprises locking means adapted to be positioned in the aligned holes.

3. A security device as described in claim 1 wherein said interconnecting means for each of said security members is a plate, and wherein said elongated members and said plate of each of said security members are welded together.

4. A security device as described in claim 1, wherein one of the elongated members in one of said pairs of elongated members has a longitudinal row of transverse openings formed therein and one of the elongated members of the other pair has a single opening which moves into alignment with each of the openings of said row as said members are moved relative to each other while installing said device, and said retaining means being adapted to be positioned in said single opening and also in one of said openings in said row with which it is aligned.

5. A security device as described in claim 4, wherein said retaining means comprises a cylindrical rod.

6. A security device as described in claim 5, wherein said cylindrical rod is one leg of a hasp of a padlock.

7. A security device as described in claim 6 wherein the elongated member having said single opening formed therein includes an integral structure partially surrounding said single opening which provides a protected space for the hasp of a padlock whose leg is positioned into said openings.

8. A security device as described in claim 5, wherein said openings comprise diametric pairs of openings in the respective elongated members.

9. A security device as described in claim 1, wherein said pair of elongated members comprises two pairs of tubes with each pair being rigidly mounted on its interconnecting means in parallel relationship and with both of said pairs having their respective tubes in axial alignment when said device is operative, the tubes of one of said pair having an outside diameter which is such as to be snugly received within the respective tubes of the other of said pairs so as to produce telescoped portions of said two tubes, said locking means comprising means extending through mating radial openings in said telescoped portions of two of said tubes.

10. A security device as described in claim 9, wherein one of said telescoped portions has a plurality of openings in longitudinal alignment whereby said telescoped portions can be locked relative to each other in a plurality of longitudinal relationships.

11. A security device as described in either claim 1 or claim 10, in combination with a door and frame construction, and means swingably mounting said door on said frame construction.

12. A security device for a swinging door comprising, the combination of, a pair of cooperating security members each of which comprises two elongated means lying on opposite sides of a door and interconnecting means secured to its associated elongated means, said interconnecting means being adapted to slide beneath the door when the door is partially or fully open and to interconnect its elongated means when the door is closed, said elongated means of the respective security means upon each side of the door being interengaged to form a rigid structure while also being movable longitudinally with respect to each other whereby the overall length of the security device may be changed between a collapsed position in which its length is less than the width of the door and an extended position in which its length is greater than the width of the door, each of said elongated means having an end portion extending beyond its interconnecting means at its end of the security device and extending beyond the vertical edge of the door when the security device is in its extended position, said elongated means being spaced from each other and extending along the opposite sides of an adjacent frame or wall structure when the door is closed and the security device is in its extended position, whereby the security device holds the door from opening when the security device is in its extended position and means to releasably retain said security members in said extended position.

* * * * *